US009956579B2

(12) United States Patent
Koschitzky

(10) Patent No.: US 9,956,579 B2
(45) Date of Patent: May 1, 2018

(54) DEVICE FOR DISPENSING GRANULAR ROOFING MEDIA ON A MOVING SHEET IN A PATTERN

(71) Applicant: IKO INDUSTRIES LTD., Toronto (CA)

(72) Inventor: Henry Koschitzky, Toronto (CA)

(73) Assignee: IKO INDUSTRIES LTD., Toronto (CA)

( * ) Notice: Subject to any disclaimer, the term of this patent is extended or adjusted under 35 U.S.C. 154(b) by 0 days. days.

(21) Appl. No.: 14/922,245

(22) Filed: Oct. 26, 2015

(65) Prior Publication Data

US 2017/0113243 A1 Apr. 27, 2017

(51) Int. Cl.

| | |
|---|---|
| ***B05C 19/04*** | (2006.01) |
| ***B05C 11/10*** | (2006.01) |
| ***B05D 1/30*** | (2006.01) |
| ***B05C 19/06*** | (2006.01) |
| *B05D 5/06* | (2006.01) |
| *E04D 1/00* | (2006.01) |

(52) U.S. Cl.

CPC ..... *B05C 19/04* (2013.01); *B05C 19/06* (2013.01); *B05D 1/30* (2013.01); *B05D 5/06* (2013.01); *B05D 2252/02* (2013.01); *B05D 2401/32* (2013.01); *E04D 2001/005* (2013.01)

(58) Field of Classification Search

None

See application file for complete search history.

(56) References Cited

U.S. PATENT DOCUMENTS

| | | | | |
|---|---|---|---|---|
| 1,194,890 | A | 8/1916 | Spiegel | |
| 1,428,931 | A * | 9/1922 | Barber | B41F 23/06 101/424.2 |
| 1,484,760 | A | 2/1924 | Cumfer | |
| 2,000,077 | A | 5/1935 | Harshberger | |
| 2,037,822 | A | 4/1936 | Robert | |
| 2,074,130 | A | 3/1937 | Penley | |
| 2,661,303 | A | 12/1953 | Fasold et al. | |
| 2,728,685 | A | 12/1955 | Muench | |
| 2,905,569 | A | 9/1959 | Zitke | |
| 2,940,422 | A | 6/1960 | Dott | |
| 3,101,281 | A | 8/1963 | Bowen, III | |

(Continued)

FOREIGN PATENT DOCUMENTS

| | | |
|---|---|---|
| CA | 2305423 | 4/1999 |

*Primary Examiner* — Jethro M Pence

(57) ABSTRACT

A method and device for dispensing granules in a pattern on a moving sheet, the device having: a granule source; a pattern roll, the pattern roll having a hollow interior and cylindrical outer surface comprising: a granule transfer zone; and an opening to the hollow interior, the method comprising: providing a flow of granules from a granule source directed toward the cylindrical outer surface of the pattern roll; rotating the pattern roll about a longitudinal axis through a granule transfer cycle comprising: a receipt portion wherein the granule transfer zone receives granules from the granule source; a retention portion wherein granules are retained in the transfer zone while the pattern roll rotates; and a release portion wherein granules dispensed onto the moving sheet; capturing a bypass flow of granules that flow through the opening into the hollow interior; and recycling the bypass flow of granules.

7 Claims, 9 Drawing Sheets

(56) References Cited

U.S. PATENT DOCUMENTS 3,730,397 A * 5/1973 Magnus ..... B05D 1/30 222/254
3,870,013 A 3/1975 Wagner
4,478,869 A 10/1984 Brady et al.
4,523,543 A 6/1985 Brady et al.
4,900,589 A 2/1990 Montgomery
5,030,314 A * 7/1991 Lang ..... A61F 13/15634 156/390
5,283,080 A 2/1994 Lamb et al.
5,405,647 A 4/1995 Grubka et al.
5,415,717 A 5/1995 Perneborn
5,547,707 A 8/1996 Haubert et al.
5,554,393 A 9/1996 Uchida et al.
5,736,084 A 4/1998 Uchida et al.
5,746,830 A 5/1998 Burton et al.
5,795,622 A 8/1998 Belt et al.
5,814,369 A 9/1998 Bockh et al.
5,858,095 A 1/1999 White et al.
5,951,760 A 9/1999 Kuenen
5,997,644 A 12/1999 Zickell
6,228,422 B1 5/2001 White et al.
6,295,947 B1 10/2001 Kuenen
6,358,319 B1 3/2002 Huykman et al.
6,440,216 B1 8/2002 Aschenbeck
6,465,058 B2 10/2002 Huykman et al.
6,582,760 B2 6/2003 Aschenbeck
6,610,147 B2 8/2003 Aschenbeck
7,163,716 B2 1/2007 Aschenbeck
8,590,582 B2 11/2013 Jackels et al.
9,186,692 B2 * 11/2015 Maruhata ..... A61F 13/1565
9,498,795 B2 * 11/2016 Svec ..... E04D 1/20
9,555,439 B2 * 1/2017 Svec ..... B05C 19/04
2002/0155254 A1 * 10/2002 McQuate ..... B05C 19/04 428/156
2007/0082126 A1 4/2007 Aschenbeck
2007/0284012 A1 * 12/2007 Smith ..... A24D 3/0225 141/1
2011/0130732 A1 * 6/2011 Jackels ..... A61F 13/15658 604/365
2011/0229636 A1 9/2011 Aschenbeck et al.
2012/0312463 A1 * 12/2012 Ogasawara ..... A61F 13/15658 156/245
2014/0044871 A1 * 2/2014 Svec ..... E04D 1/26 427/188

* cited by examiner

DEVICE FOR DISPENSING GRANULAR ROOFING MEDIA ON A MOVING SHEET IN A PATTERN

TECHNICAL FIELD

The invention relates to a method of and device for dispensing granular roofing media on a moving sheet in a predetermined pattern using a pattern roll that provides accurate control of the volume and locating of granular media that is transferred by the pattern roll to the moving sheet.

BACKGROUND OF THE ART

The manufacture of some asphalt roofing products includes a moving sheet, of fiberglass fabric, paper or composite materials, coated with a mixture of asphalt and filler, then applying colored granular media to the asphalt coated surface as the sheet runs under a transverse curtain of falling granules. The sheet is cooled and cut into asphalt shingles.

Conventional granule dispensing is carried out using a rotating fluted roll that starts and stops thus dispersing granules onto the sheet. An example of a conventional fluted roll granule dispenser is described in United States Patent Publication US 2011/0229636 and need not be described in further detail here.

There is a need for depositing granules in clearly defined patterns, and for controlling the volume of granules to produce uniform layers over their length from the transverse leading edge to the transverse trailing edge.

Using conventional dispensers, a pattern rectangular patches of different color blends contiguous to each other is achieved by dropping different granules using multiple dispensers in a lengthwise consecutive series as the sheet proceeds downstream. Because the start and stop of granule flow from the conventional dispensers is not instantaneous, there are areas produced where there is not a sufficient thickness of granules and these areas are contaminated by the adjacent overlapping layers of other color mixtures. The leading and trailing edges taper in thickness which prevents the production of a clear division between the adjacent rectangular patches of different colors.

Features that distinguish the present invention from the background art will be apparent from review of the disclosure, drawings and description of the invention presented below.

DISCLOSURE OF THE INVENTION

The invention provides a method of dispensing granules in a pattern on a moving sheet conveyed beneath a dispensing device, the dispensing device having: a conveyor for conveying the moving sheet; and a dispensing apparatus above the moving sheet, the dispensing apparatus comprising: a granule source; a pattern roll, the pattern roll having a hollow interior and cylindrical outer surface, the cylindrical outer surface comprising: a granule transfer zone; and an opening to the hollow interior, the method comprising: providing a flow of granules from a granule source directed toward the cylindrical outer surface of the pattern roll; rotatably driving the pattern roll about a longitudinal axis through a granule transfer cycle comprising: a receipt position portion wherein the granule transfer zone includes recesses that receive granules from the granule source; a retention position portion wherein granules are retained in the recesses of the transfer zone while the pattern roll rotates; and a release position portion wherein granules are dispensed from the recesses onto the moving sheet; capturing a bypass flow of granules that flow through the opening into the hollow interior; and conveying the bypass flow for recycling.

DESCRIPTION OF THE DRAWINGS

In order that the invention may be readily understood, one embodiment of the invention is illustrated by way of example in the accompanying drawings.

Further details of the invention and its advantages will be apparent from the detailed description included below.

DETAILED DESCRIPTION OF PREFERRED EMBODIMENTS

Figure 1:
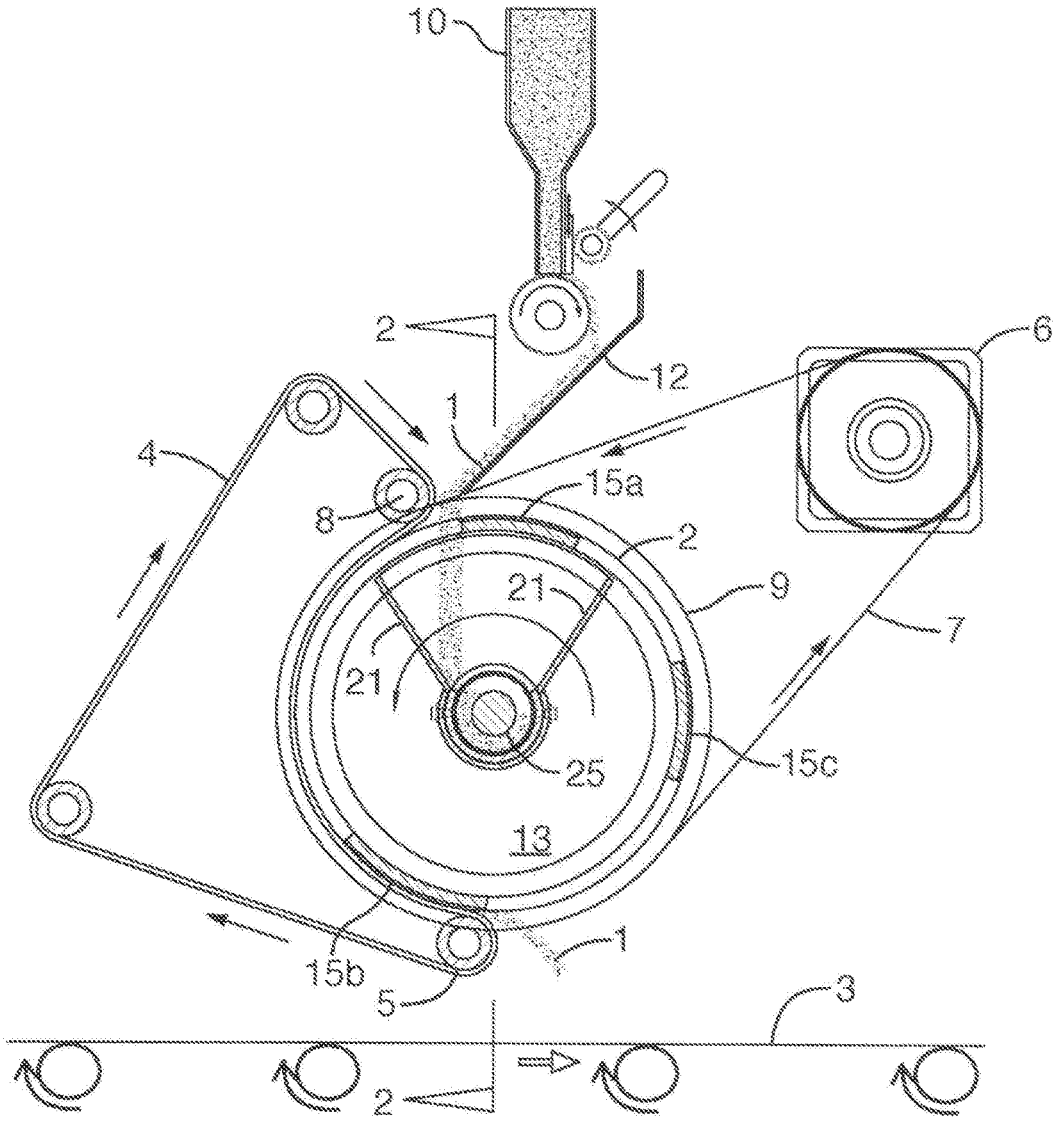
FIG. 1 is a longitudinal cross-sectional view through the granule dispensing device in the machine direction conveying the asphalt coated sheet from left to right and dispensing granules from a counter-clockwise rotating pattern roll.
Figure 2:
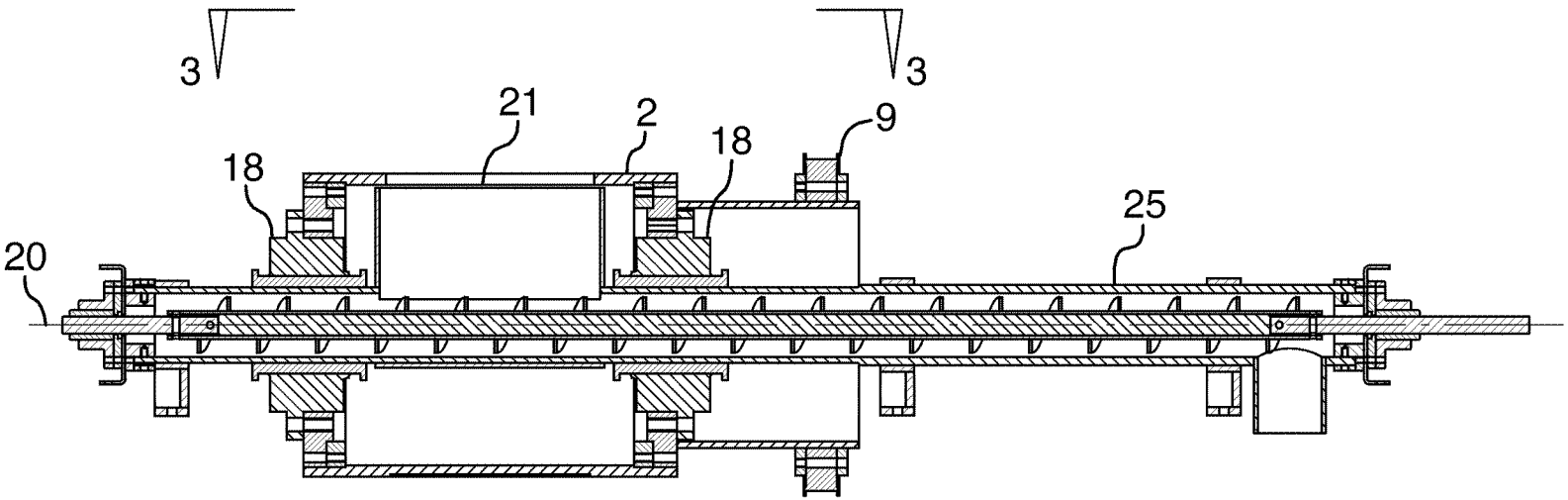
FIG. 2 is a cross-sectional view along the transverse axis of the pattern roll, on line 2-2 of FIG. 1.

FIG. 1 shows a dispensing device for dispensing granules 1 in a selected pattern. Granules 1 are dispensed from a pattern roll 2 onto a moving sheet 3 that is conveyed beneath the pattern roll 2. The moving sheet 3 is coated with filled asphalt and remains tacky to adhere to the granules 1. The granules 1 fall under gravity from the pattern roll 2 when released from recesses in the outer surface of the pattern roll 2. Granules 1 are released when the retention belt 4 disengages the pattern roll 2 passing over the lower roller 5.

As drawn, the pattern roller 2 rotates counterclockwise and the sheet 3 passes left to right. A drive motor 6, a toothed drive belt 7, and a sprocket 9 rotate the pattern roller 2 about the longitudinal axis 20 supported on ring bearings 18. The flexible retention belt 4 engages the outer cylindrical surface of the pattern roll 2 between the upper roller 8 and the lower roller 5 to retain the granules 1 within recesses in the outer surface of the pattern roll 2.

The dispensing of granules 1 proceeds generally from top to bottom with the granule dispenser 10 controlling the flow of granules 1 to the granule deflector guide 12. The granules 1 flow under gravity from an outlet of the granule dispenser 10 to the curved granule deflector guide 12, and then fall downward towards the pattern roll 2.

Figure 3:
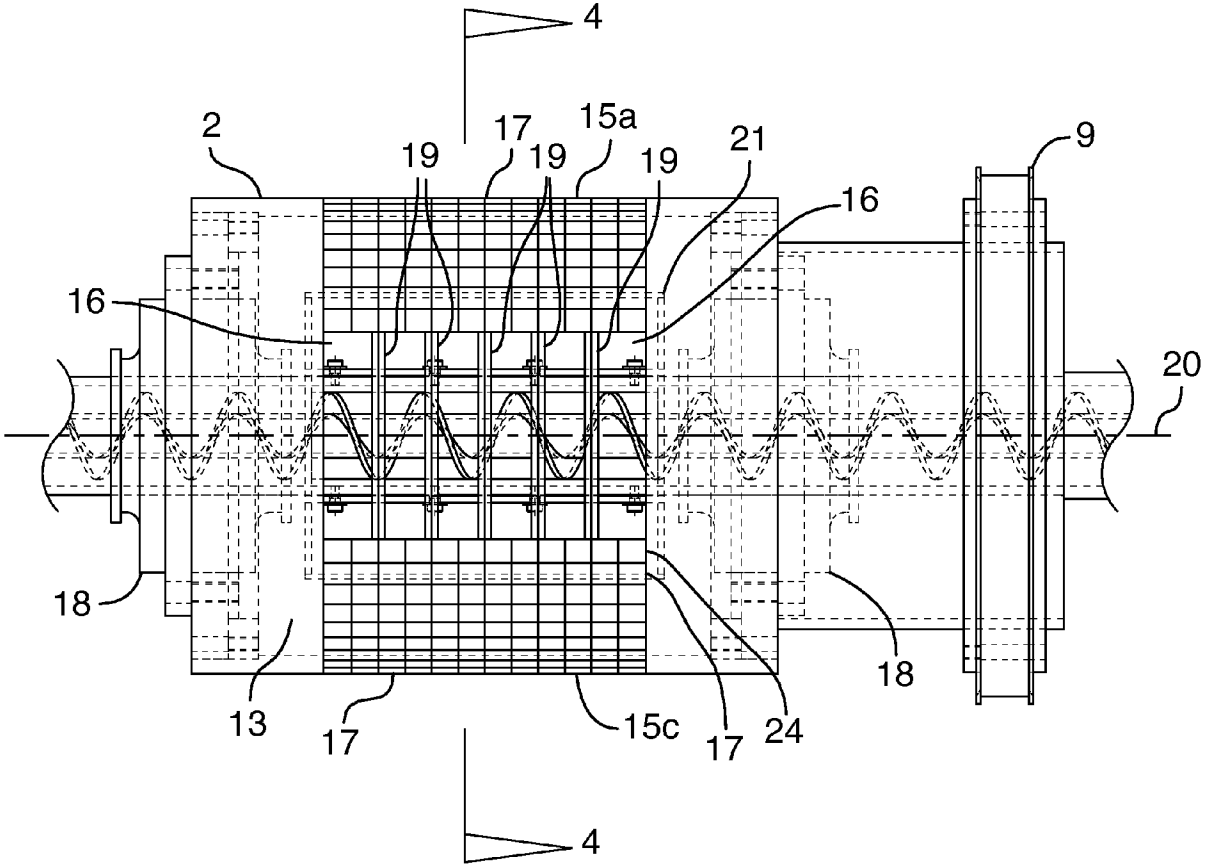
FIG. 3 is a transverse side view of the pattern roll, along line 3-3 of FIG. 2.

As best seen in FIG. 3, the pattern roll 2 has a hollow interior 13 and cylindrical outer surface. The cylindrical outer surface has a middle band where granules 1 supplied by one or more granule dispensers 10 are dropped from the granule deflector guide 12. Granules 1 are either: captured within recesses 17 in one of three granule transfer zones 15*a*, 15*b*, 15*c*; or pass through openings 16 into the hollow interior 13. The example shown in FIGS. 1-4 includes three circumferentially spaced apart granule transfer zones 15*a*-15*c* being a thick curved plate with recesses 17 machined into the plate. The cylindrical outer surface of the pattern roll 2 includes the transfer zones 15*a*-15*c* with hoop members 19 defining the openings 16. The hoop members 19 support the retaining belt 4 in a cylindrical shape while the retaining belt 4 passes over the openings 16.

As shown in FIG. 1, the method of operating the granule dispensing device commences with providing a flow of granules 1 from the granule dispenser 10 directed with the granule deflector guide 12 toward the top portion of cylindrical outer surface of the pattern roll 2. The pattern roll 2 is driven to rotate counterclockwise about it's longitudinal axis 20 through a granule transfer cycle. FIG. 1 shows the initiation of the receipt position portion of the granule transfer cycle where granule transfer zone 15*a* (one of the three granule transfer zones 15*a*, 15*b*, 15*c*) is positioned to receive granules 1 from the granule deflector guide 12. Any granules 1 that are not captured by the transfer zones 15*a*-15*c*, will fall through the openings 16 into the hollow interior 13 of the pattern roll 2. Within the hollow interior 13 of the pattern roll 2 is an intake chute 21 with an open top to capture falling granules 1 that are then conveyed axially with a screw auger 25 for recycling.

As seen in FIG. 1, the granule transfer cycle of the pattern roll 2 includes a retention portion where granules 1 are retained in the recesses of the transfer zone 15*b* by the flexible retention belt 4 while the pattern roll 2 rotates. When the transfer zone 15*b* rotates counter-clockwise past the position shown in FIG. 1, the granule transfer cycle commences the release position portion of the cycle. Granules 1 are released from the recesses as the belt 4 moves away from the pattern roll 2 about the lower roller 5 and granules 1 are then dispensed down onto the moving sheet 3.

Figure 4:
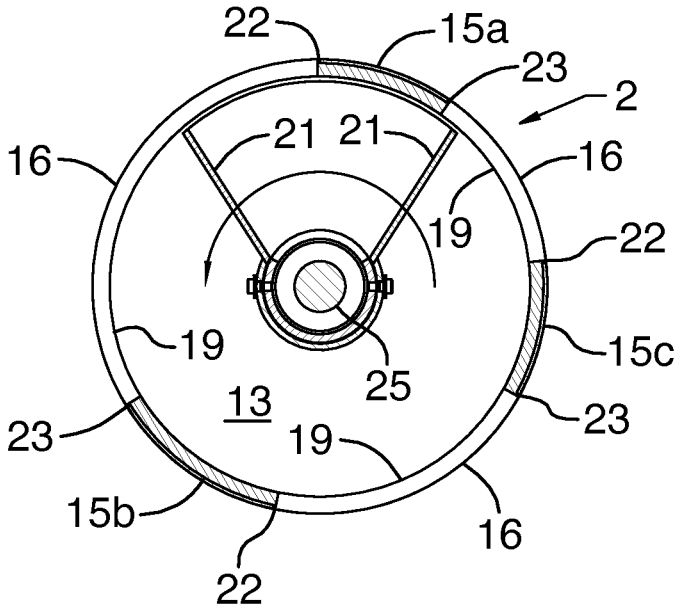
FIG. 4 is longitudinal cross-sectional view of the pattern roll, the intake chute and central axial screw auger conveyor for recycling granules, along line 4-4 of FIG. 3.

As seen in FIG. 4, there are three transfer zones 15*a*, 15*b*, 15*c* all of which are rectangular in shape with regular spaced apart rows of recesses 17, shown in FIG. 3. The example arrangement will distribute granules 1 onto the moving sheet 3 in generally rectangular shaped patches that are spaced apart by the absence of granules 1 in the areas of the openings 16 in the pattern roll 2. The shape of the transfer zones 15*a*-15*c* need not be limited to a rectangular shape as in the drawings. Any shape can be used such as round, irregular curved shapes, silhouettes or letters for example. The depositing of patches of granules on the moving sheet is somewhat analogous to offset printing, where a pattern of granules (rather than printing ink) are deposited into recesses on a roll, then transferred from a roll to a moving sheet. Accordingly any desired shape can be transferred that can fit on the cylindrical roll surface.

FIGS. 5 to 8 are schematic representations of the steps in the method described above. In the example shown in FIGS. 5-8 the pattern roll 2 has three transfer zones (15*a*-15*c*). Any number of transfer zones 15*a*-*c* can be included in a pattern roll 2. FIGS. 5-8 include two granule feeders 10 and 14, however it will be understood that any number of granule feeders 10 could be arranged in a similar manner to supply granules 1 to the pattern roll 2.

FIGS. 5-8 show the details of filling the recesses 17 of the transfer zones 15*a*-*c* as granules are transferred from the granule dispenser 10 to the pattern roll 2, then from the pattern roll 2 to the moving sheet 3.

Figure 5:
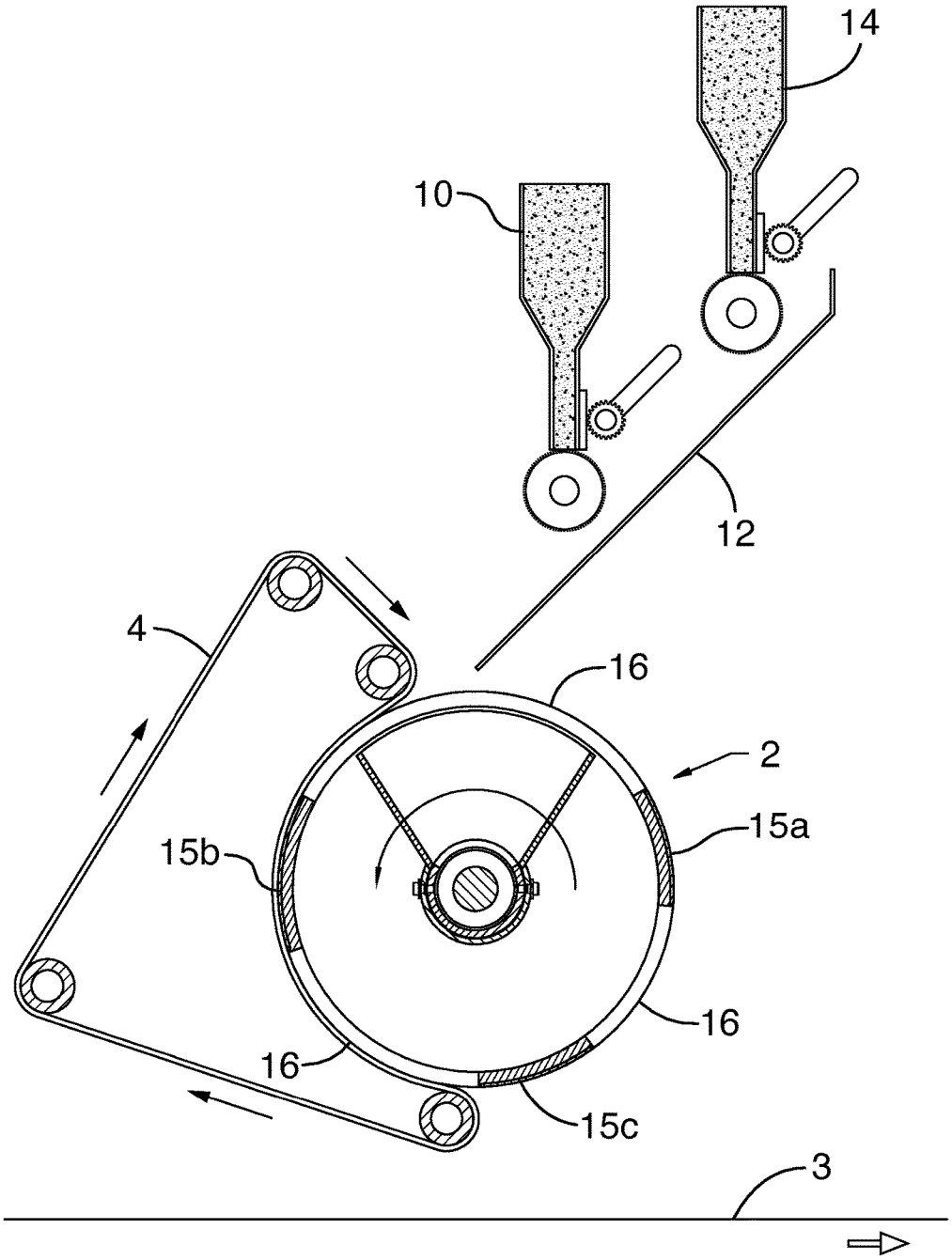
FIGS. 5 to 8 are schematic drawings, of the operation of the granule dispensing device showing the progressive steps starting with FIG. 5 in coordinating the filling of the recesses in the transfer roll with granules with the operation of the granule dispenser. A second granule dispenser is shown for dispensing a second color blend of granules.

FIG. 5 shows the granule dispensers 10 and 14 stopped so that no granules 1 are supplied to the granule deflector guide 12. The pattern roll 2 rotates counterclockwise and the belt 4 engages the pattern roll 2. The step shown in FIG. 5 is graphically represented in FIG. 9 by the time period A-B where the granule flow rate is zero.

Figure 6:
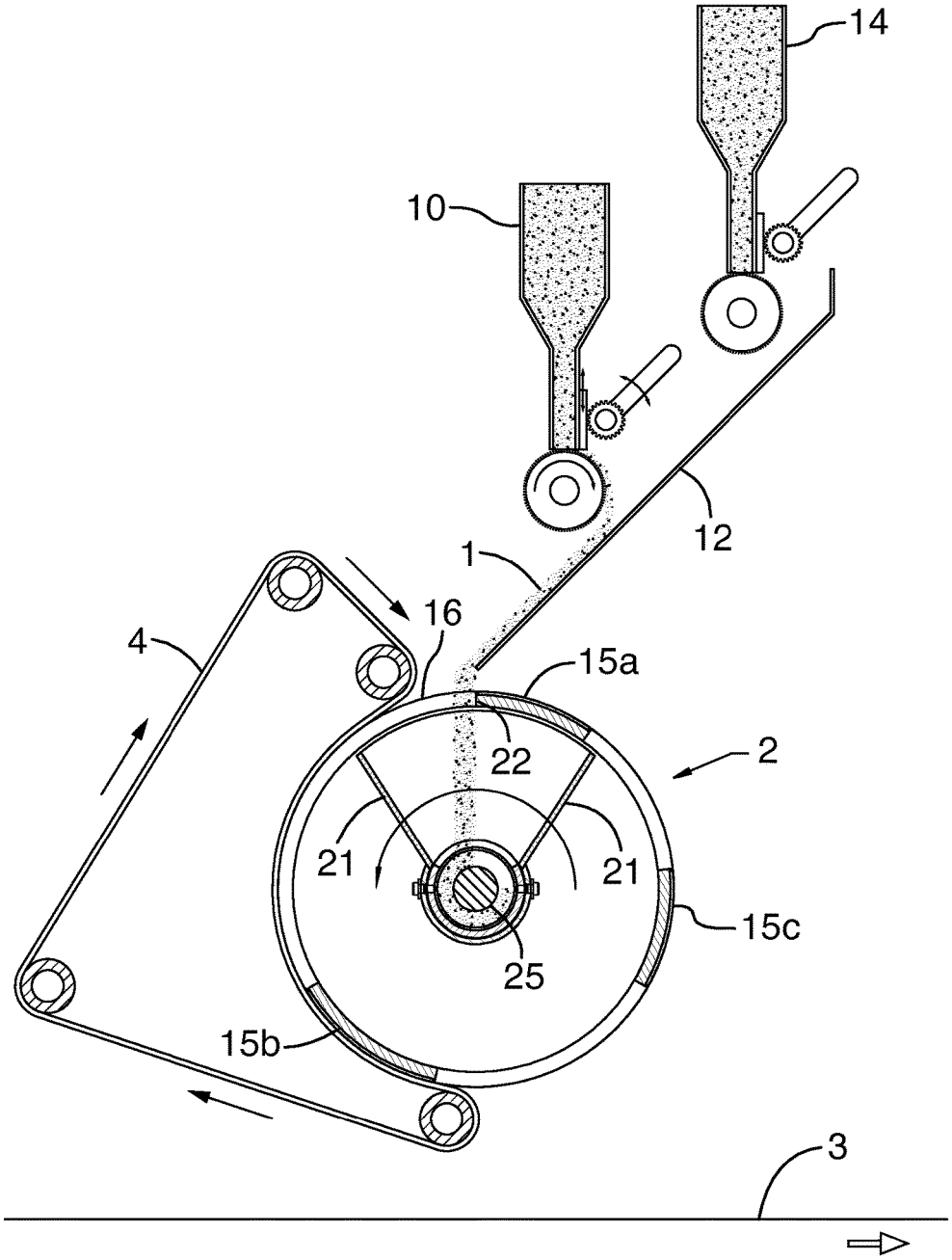

FIG. 6 shows that when the transfer zone 15*a* is further rotated, in advance of the passage of the leading edge 22 past the lower end of the granule deflector guide 12, the granule dispenser 10 initiates the metered flow of granules 1 to slide down the granule deflector guide 12. The flow rate of granules 1 passing over the lower end of the granule deflector guide 12 is graphically represented in FIG. 9 by the time period B-C where the granule flow rate begins from zero and builds to a predetermined constant flow rate M. Until the flow rate reaches the uniform flow rate M, the granules 1 are bypassed into the opening 16 and do not fill the recesses 17 in the transfer zone 15*a*. The bypass flow of granules 1 falls into the intake chute 21 and is conveyed by the screw auger 25 to recycling.

Figure 7:
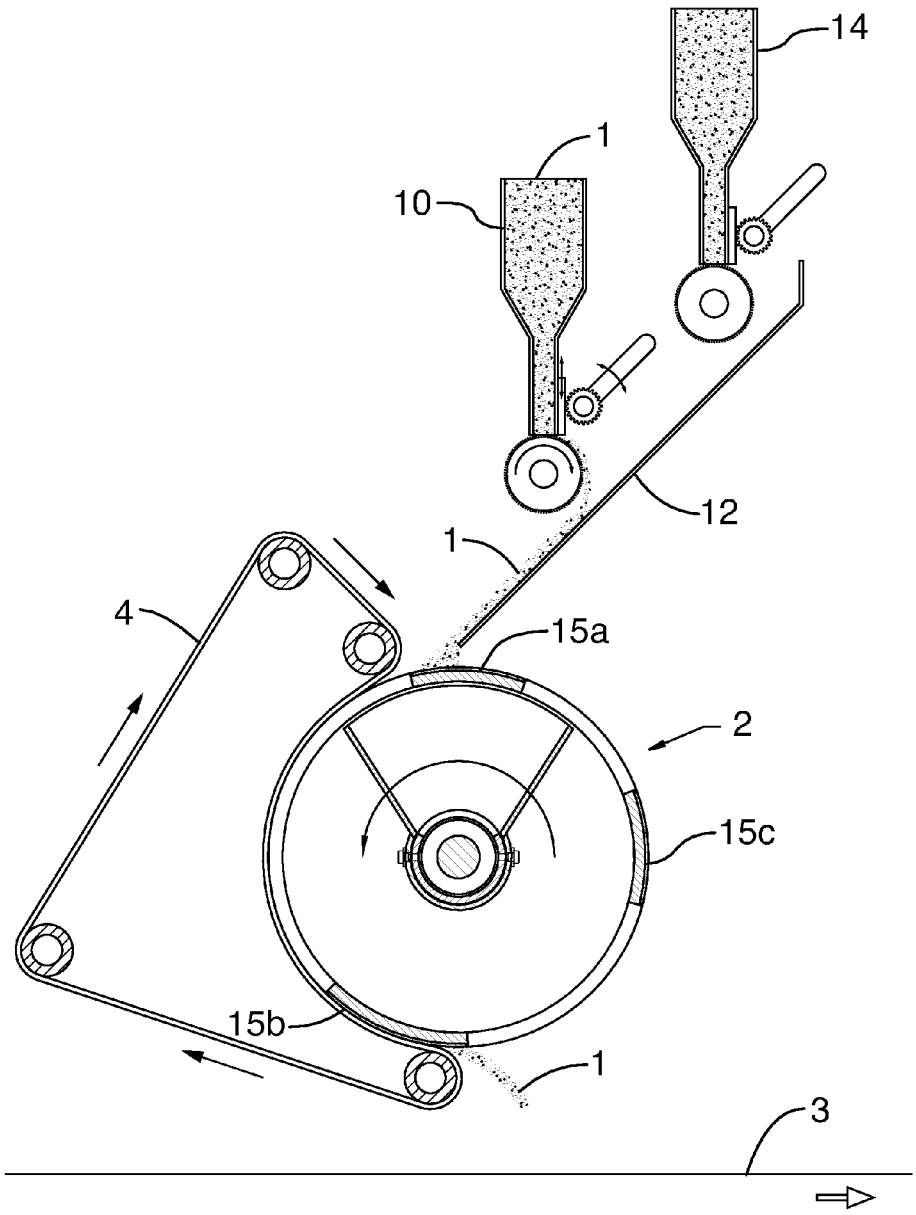

FIG. 7 shows the transfer zone 15*a* receiving granules 1 in the recesses 17. The flow rate remains at the predetermined constant flow rate M, represented in FIG. 9 by the time period C-D. The pattern roll 2 continues counterclockwise rotation and the granule dispenser 10 delivers granules 1 to fill the recesses 17. The dispensed volume of granules 1 within the recesses 17 is less than the maximum volume capacity of the recesses 17. The dispensed volume of granules 1 is fine tuned to a high degree of accuracy to produce a more uniform pattern and color on the finished product.

Figure 8:
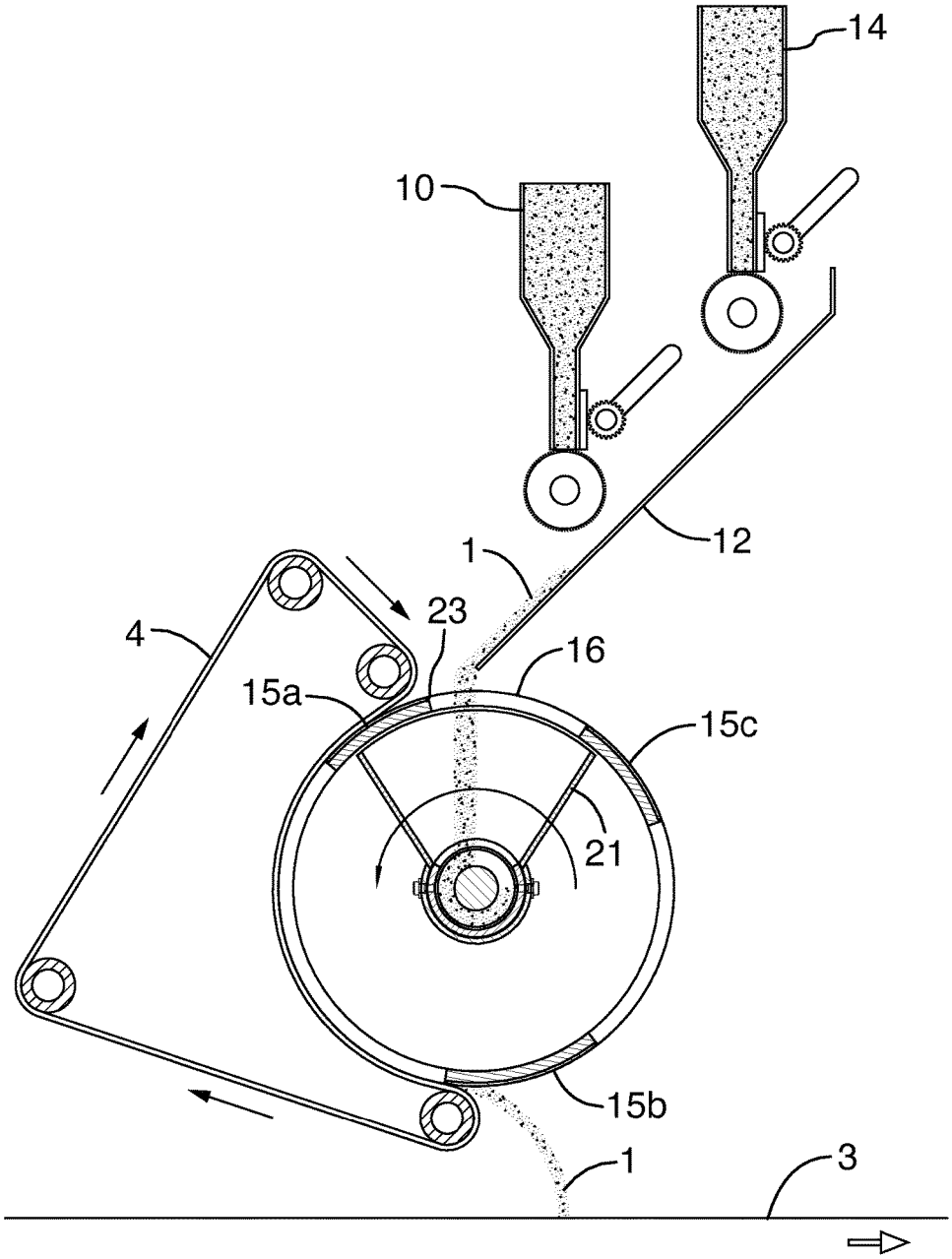

FIG. 8 illustrates the following stage where the granule dispenser 10 is stopped thereby stopping the supply of granules 1 after the trailing edge 23 of the transfer zone 15*a* has passed the lower end of the granule deflector guide 12. FIG. 8 shows that the granules 1 continue to flow from the lower end of the granule deflector guide 12 after the passage of the trailing edge 23. A terminal portion of the bypass flow of granules 1 flows through the following opening 16 into the intake chute 21 for recycling. The flow rate past the lower end of the granule deflector guide 12 reduces to zero from the predetermined constant flow rate M, represented in FIG. 9 by the time period D-A.

The granules 1 continue to fall from the deflector guide 12 into the opening 16 for time period D-A after the granule dispenser 10 stops. The cycle begins again with transfer zone 15*c* approaching the position of 15*a* in FIG. 5. The dispensing of granules 1 from transfer zone 15*d* at the bottom of the transfer roll 2 is shown in the progression from FIGS. 5 to 8. Each transfer zone 15*a*-*c* progresses through the steps as the pattern roll 2 rotates. The next cycle can be served again by the same dispenser 10 or the second granule dispenser 14 containing a different colour blend or any other dispenser connected to the guide 12. Each of the three consecutive transfer zone 15*a*-15*b*-15*c* could be filled with three different color mixtures of granules 1 in any sequence if three granule dispensers (10, 14 and a third not shown) are provided.

Figure 9:
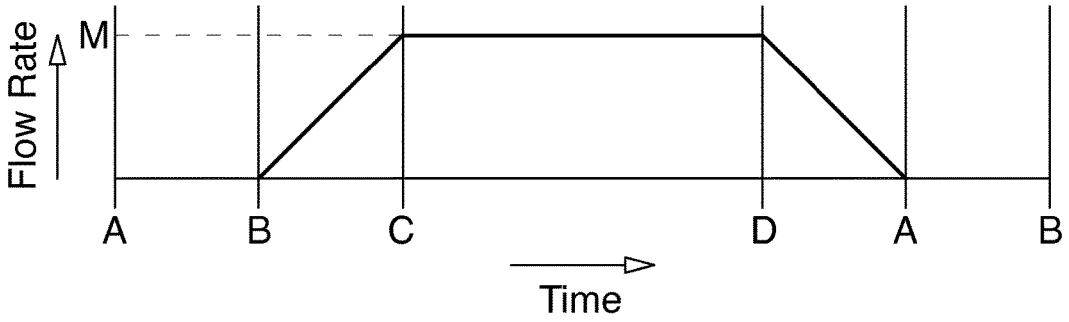
FIG. 9 is a graphical representation of the granule dispenser operation, with granule flow rate on the vertical axis versus time on the horizontal axis, illustrating the coordinated timing of granule flow through the stages of: starting flow; uniform continuous flow; and stopping flow.

As graphically represented in FIG. 9, the bypass flow of granules 1 in time periods B-C and D-A are captured by the intake chute 21. The uniform flow of granules 1 in time period C-D at the full constant flow rate M is captured by the recesses 17 of the transfer zones 15*a*-15*c*. Therefore the flow of granules 1 to fill the recesses 17 is always delivered at the uniform flow rate M. Flow rates of granules delivered at less than the uniform rate M, during time periods B-C and D-A are bypassed and captured by the openings 16 for recycling.

The equal filling of the recesses 17 results in a patch of granules 1 deposited on the sheet 3 that has a uniform thickness of granules 1 throughout. The problem of conventional methods, namely tapered leading-trailing edge thickness and visually indistinct boundaries, is overcome thereby.

FIG. 9 illustrates the changes in flow rate when a single transfer zone (ex. 15*a*) is filled in a timed sequence.

There is a requirement to coordinate the start and stop of the granule dispensers 10 and 14 with the positions of the transfer zones 15*a-c* as the pattern roll 2 rotates so that the full flow of granules is in place where the start of the transfer zones 15*a-c* are directly under the discharge of the granule deflection guide 12.

Although the above description relates to a specific preferred embodiment as presently contemplated by the inventor, it will be understood that the invention in its broad aspect includes mechanical and functional equivalents of the elements described herein.

The invention claimed is:

1. A device, for dispensing granules in a pattern on a moving sheet conveyed beneath the device, comprising:

a conveyor for conveying the moving sheet; and a dispensing apparatus above the moving sheet, the dispensing apparatus comprising:

a granule source;

a pattern roll rotatably driven about a longitudinal axis through: a receipt position; a retention position; and a release position, of a granule transfer cycle, the pattern roll having a hollow interior and a cylindrical outer surface, the cylindrical outer surface comprising:

a granule transfer zone for: receiving granules from the granule source into a plurality of recesses in the cylindrical outer surface while in the receipt position; retaining granules in the recesses in the cylindrical outer surface while the pattern roll rotates through the retention position; and dispensing granules from the recesses in the cylindrical outer surface when in the release position;

at least one granule bypass opening passing through the cylindrical outer surface to the hollow interior; and a granule conveyor for recycling granules, that flow through the at least one granule bypass opening into the hollow interior.

2. The device according to claim 1, wherein the granule conveyor comprises an intake chute within the hollow interior of the pattern roll, the intake chute having an open top adjacent the at least one granule bypass opening.

3. The device according to claim 2, wherein the granule conveyor comprises a screw auger extending longitudinally through an open end of the pattern roll, and the intake chute comprises a hopper with radially extending longitudinal side walls, the screw auger being disposed in a bottom portion of the hopper.

4. The device according to claim 1, wherein the at least one granule bypass opening defines at least one edge of the granule transfer zone.

5. The device according to claim 4, wherein the at least one granule bypass opening defines at least one of: a longitudinal edge; a circular edge; a helical edge; and a curve edge, of the granule transfer zone.

6. The device according to claim 1, further comprising:

a retention belt engaging the pattern roll in the retention position of the granule transfer cycle wherein the retention belt covers the recesses of the granule transfer zone.

7. The device according to claim 1, wherein the granule source comprises at least one granule dispenser, and a granule deflector guide between an outlet of the granule dispenser and the pattern roll.

* * * * *